US005394994A

United States Patent [19]

Coblentz et al.

[11] Patent Number: 5,394,994

[45] Date of Patent: Mar. 7, 1995

[54] ADJUSTABLE RISER PIN PAD HOLDER WITH MOUNTING PROVISIONS FOR A PRINTER HOLDER

[75] Inventors: Fred C. Coblentz, Lake Forest; William D. Watt, Walnut, both of Calif.

[73] Assignee: Atlantic Richfield Company, Los Angeles, Calif.

[21] Appl. No.: 98,690

[22] Filed: Jul. 28, 1993

[51] Int. Cl.[6] ..... A47F 5/00

[52] U.S. Cl. ..... 211/13; 211/207; 248/176; 248/454

[58] Field of Search ..... 211/207, 208, 13, 50; 248/449, 161, 411, 413, 157, 676, 441.1, 454, 457

[56] References Cited

U.S. PATENT DOCUMENTS

| | | | |
|---|---|---|---|
| 872,905 | 12/1907 | Connors | 248/441.1 X |
| 2,006,580 | 7/1935 | Brown | 248/454 |
| 2,678,182 | 5/1954 | Young | 248/454 |
| 3,984,075 | 10/1976 | Bahner et al. | 248/454 X |
| 4,478,382 | 10/1984 | Canier | 248/176 X |
| 4,817,903 | 4/1989 | Braehler et al. | 248/157 X |
| 5,080,315 | 1/1992 | Tucker-Schafer | 248/441.1 |
| 5,152,491 | 10/1992 | Forster et al. | 248/454 |
| 5,284,253 | 2/1994 | Watt et al. | 211/13 |
| 5,289,923 | 3/1994 | Coblentz et al. | 211/13 |

*Primary Examiner*—Robert W. Gibson, Jr.
*Attorney, Agent, or Firm*—Joseph E. Rogers

[57] ABSTRACT

An article of manufacture for providing easy access to electronic key pads and magnetic card readers is provided. The article includes recessed areas for the holding of such key pads and printers at suitable angles to afford easy access and reduces the amount of counter space necessary to utilize such equipment, adjustable to various heights and providing security for entries to the pin pad.

2 Claims, 1 Drawing Sheet

ADJUSTABLE RISER PIN PAD HOLDER WITH MOUNTING PROVISIONS FOR A PRINTER HOLDER

CROSS REFERENCE TO RELATED APPLICATIONS

This Application is cross-related to U.S. patent application Serial No. 29/011,160 entitled "ADJUSTABLE RISER PIN PAD HOLDER WITH MOUNTING PROVISIONS FOR A PRINTER HOLDER" by Fred Coblentz and William Watt, which is owned by a common assignee.

FIELD OF THE INVENTION

This application relates to an article of manufacture used to hold and provide access to electronic key pads and printers.

BACKGROUND OF THE INVENTION

Retail establishments and other commercial outlets usually permit several different options of payment for goods and services. Traditionally, these have included cash, check, and credit card. More recently, certain outlets now permit the use of debit cards which transfer funds from the customer's account to the seller's account electronically through the use of a debit card.

Debit cards owe their efficiency to communications systems which link directly various banks and retail establishments. The vehicle by which the customer debits his account is a credit-card-like card, having a magnetic strip and certain information stored on that magnetic strip. Typically, the debit card is slid through a magnetic card reader, either by the customer or by the seller. Customer then enters a secret personal identification number on a keypad sometimes referred to as pin pad which, when verified, will permit the debiting of customer's account and the crediting of seller's account.

More and more of such systems are being used by retailers for whom counter space is at a premium. In addition, they result in the customer spending additional time in checkout lines. These problems are especially acute for small retailers with limited counter space.

In addition to the need for counter space, checkout lines at retailers are of different designs and heights. Retailers also desire to minimize protrusions of objects into their retail checkout lines. Additionally, the technology associated with such systems is rapidly evolving and the pin pad and printer designs and corresponding sizes are fast changing.

Therefore, there is a need for a compact, adjustable height, and inexpensive holder which can accommodate a number of pin pads and printers.

SUMMARY OF THE INVENTION

The present invention includes a pin pad holder having a base comprising a first holder having a first face connected on one side to and forming a first acute angle between the base and the first face and having portions defining a first recess; and a security shield attached perpendicular to the plain of the first face for reducing observation of pin pad entries; and an adjustable riser for adjusting the height of the base above a countertop.

This invention aids in solving the problems discussed above and has several advantages. The pin pad holder provides for an efficient height and angle for easy data entry into the pin pad and easy access to the printer.

The holder also provides a universal mounting means for various types of pin pads and printers as well as an adjustable height capable of being used in many locations. In addition, the holder provides for additional security for debit card holder's personnel identification number.

FIGURES

Our invention can be understood by using the description of the preferred embodiments provided below in conjunction with the attached figures wherein.

DESCRIPTION OF THE PREFERRED EMBODIMENT

Figure 1:
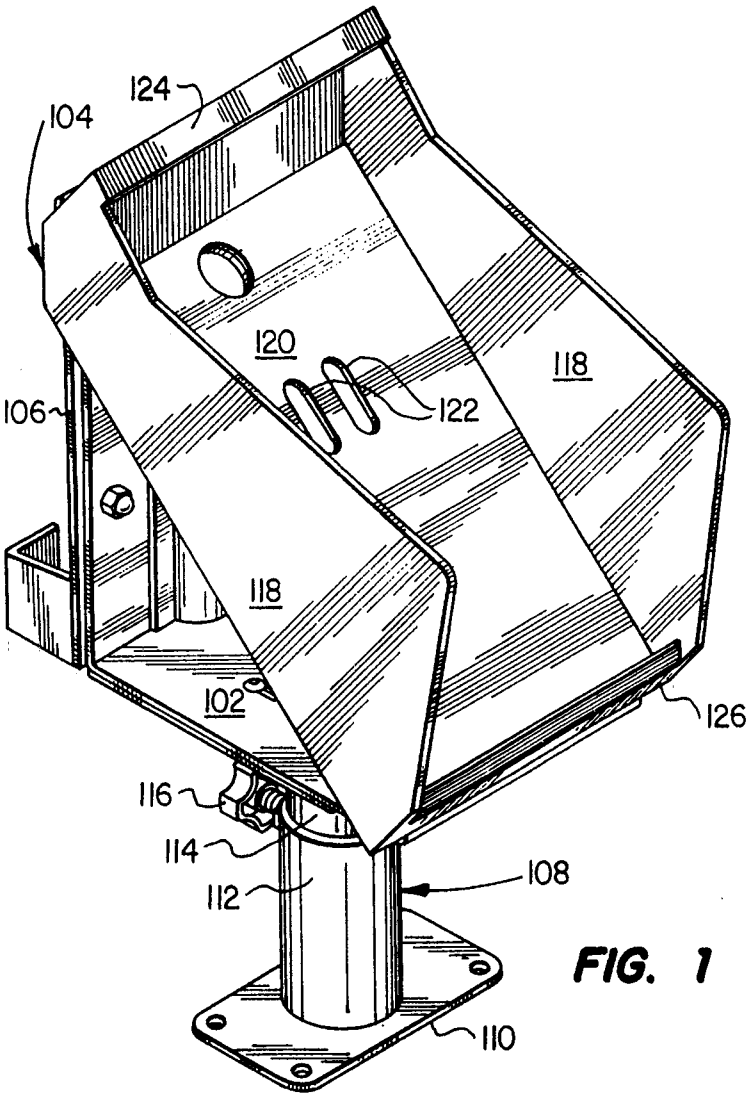
FIG. 1 is a front perspective view of an adjustable riser pin pad holder with mounting provisions for a printer holder used in conjunction with electronic payment systems.

FIG. 1 is a front perspective view of an adjustable riser pin pad holder with mounting provisions for a printer holder used in conjunction with electronic payment systems. For the purposes of this description, holder 100 will be described in terms of component parts, but our invention may be formed in a single injection or molding process as are well known in the art. Holder 100 may be constructed of any one of a number of materials including, but not limited to, plastic, Plexiglas, or other similar material, or may be fabricated from metal and may be a series of components which are attached one to the other by means of either fasteners or glue or some other suitable attaching means which are well known in the art.

Holder 100 has a base 102 to which a pin pad holder 104 and a printer holder 106 are attached. Base 102 is a universal mounting base which can modified to accommodate various sizes of pin pad holders 104 and printer holders 106 for various manufacturers' pin pads and printers which are well known in the art. Adjustable riser 108 is attached to a plate 110. Plate 110 may then be attached to, for example, the countertop at the retail establishment. Adjustable riser 108 includes a fixed portion 112 and a slideable portion 114 capable of slideably fitting into fixed portion 112. A locking device 116 is attached to the fixed portion 112. Locking device 116 is capable of permitting the adjustment of height of base 102 above counter top (not shown). Locking device 116 can be a friction-type device as shown, or a pin or any other type of device which permits the adjustment of the height of base 102 above a counter top.

Pin pad holder 104 has sidewalls 118 which serve as shields to provide for secure entry of personal identification numbers associated with the customer's debit card. Sidewall 118 is suitably shaped to reduce its protrusion into the checkout lane. The bottom of pin pad holder 120 has openings 122 suitable for providing cable access through openings in base 102 (not shown) to the underside of the pin pad. Pin pad holder 104 also has an upper ledge 124 under which the pin pad is inserted to hold it in place. In addition, pin pad holder 104 has a bottom lip 126 which retains the upper portion of the pin pad (not shown) under ledge 124 after insertion.

Figure 2:
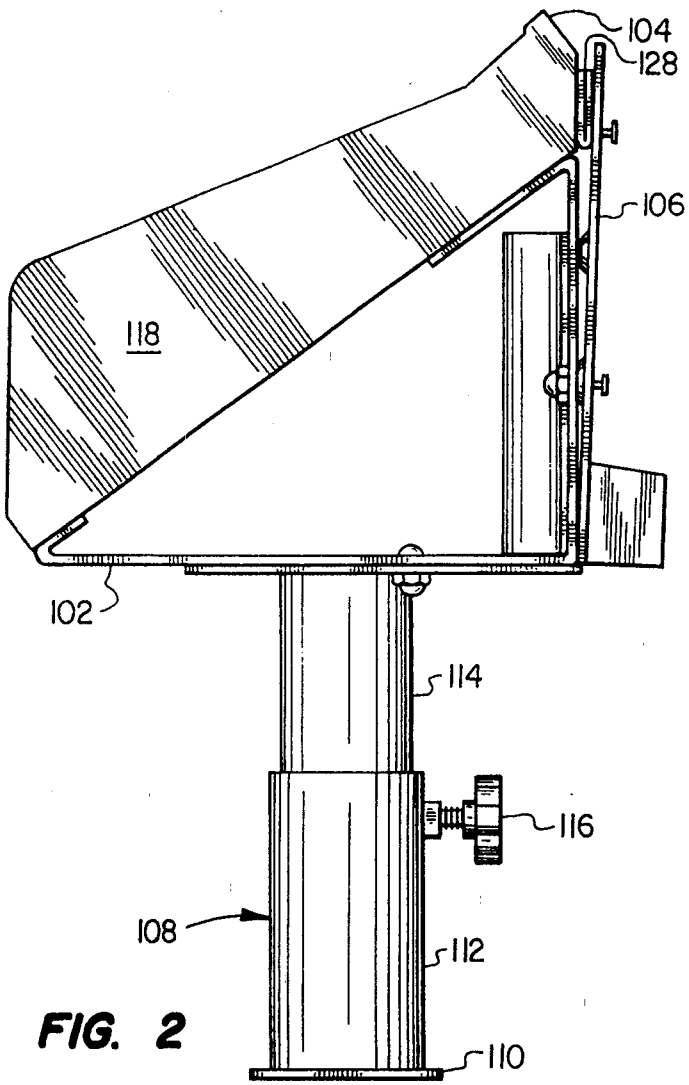
FIG. 2 is a right side elevational view of the adjustable riser pin pad holder of FIG. 1.

Printer holder 106 can accommodate any one of a number of associated printers which are well known in the art and is suitably a size to allow the printer to rest in the printer holder 106. Referring now to FIG. 2, there is shown a right side elevational view of the adjustable riser pin pad holder of FIG. 1. As can be seen in FIG. 2, a signage holder 128 is positioned at the top of pin pad holder 104 and printer holder 106. Signage holder 128 is suitable for receiving any one of a number of signs for providing information regarding such items as operation of the pin pad and available networks.

In installation, height of the pin pad holder can be adjusted to a desired height above a counter top at a retail establishment by loosening locking device 116 and moving base up or down to the desired height and then re tightening locking device 116.

In operation, referring now to FIG. 2, a debit card would be slipped in through a slot to a pin pad (not shown). Customer could then enter his personal identification number to complete the transaction on the pin pad. When the transaction was complete, a receipt or signable document could be provided by a printer (not shown). In addition, the angle of the face pin pad holder 104 is designed to provide easy access to the entry keys of the pin pad as well as to provide security for the customers personal identification number by obstruction of the view of pin pad entries through the use of sidewalls 118.

Although several embodiments have been described in detail, it should be understood that various changes, substitutions and alterations can be made therein without departing from the spirit and scope of the invention as defined by the appended claims.

We claim:

1. A pin pad holder having a base comprising:

(a) a first holder having a first face connected on one side to and forming a first acute angle between the base and the first face and having portions defining a first recess; and (b) a security shield attached perpendicular to the plane of said first face for reducing observation of pin pad entries; and (c) an adjustable riser for adjusting the height of the base above a counter top.

2. The pin pad holder of claim 1 further including a holder capable of receiving a printer generally facing in the opposite direction from said first face.

* * * * *